US005798321A

United States Patent [19]

Wisotsky et al.

[11] Patent Number: 5,798,321

[45] Date of Patent: Aug. 25, 1998

[54] RUST RESISTANT TURBO OILS CONTAINING MONOBASIC AMINO PHOSPHATES AND DICARBOXYLIC ACIDS

[75] Inventors: Max J. Wisotsky, Highland Park; Morton Beltzer, Westfield, both of N.J.; Thomas L. Ashcraft, Leander, Tex.; Paul Joseph Berlowitz, East Windsor, N.J.

[73] Assignee: Exxon Research and Engineering Company, Florham Park, N.J.

[21] Appl. No.: 599,641

[22] Filed: Feb. 9, 1996

Related U.S. Application Data

[63] Continuation of Ser. No. 447,509, May 23, 1995, abandoned.

[51] Int. Cl.[6] ..... C10M 129/26; C10M 129/92; C10M 137/08

[52] U.S. Cl. ..... 508/437

[58] Field of Search ..... 252/32.5, 508

[56] References Cited

U.S. PATENT DOCUMENTS

| | | | |
|---|---|---|---|
| 2,773,032 | 12/1956 | Cantrell et al. | 252/32.5 |
| 3,344,068 | 9/1967 | Waight et al. | 252/47 |
| 3,585,137 | 6/1971 | Bosniak et al. | 252/32.5 |
| 3,634,239 | 1/1972 | MacPhail et al. | 252/32.5 |
| 3,720,612 | 3/1973 | Bosniak et al. | 252/32.5 |
| 3,979,308 | 9/1976 | Mead et al. | 252/32.5 |
| 4,130,494 | 12/1978 | Shaub et al. | 252/32.5 |
| 4,226,732 | 10/1980 | Reinhard et al. | 252/32.5 |
| 4,655,946 | 4/1987 | Metro et al. | 252/32.5 |
| 4,800,029 | 1/1989 | Dasai | 252/32.5 |

*Primary Examiner*—Margaret Medley
*Attorney, Agent, or Firm*—Joseph J. Allocca

[57] ABSTRACT

A turbo oil possessing improved rust inhibiting properties is provided by adding to the turbo oil base stock minor amounts of monobasic aminophosphates and dicarboxylic acids. The use of the recited combination produces unexpected superior rust resistance performance as compared to use of the individual components. The turbo oil benefitted by the additive is preferably a polyol ester-based oil.

7 Claims, 1 Drawing Sheet

RUST RESISTANT TURBO OILS CONTAINING MONOBASIC AMINO PHOSPHATES AND DICARBOXYLIC ACIDS

CROSS REFERENCE TO RELATED APPLICATION

This is a Rule 60 Continuation of U.S. Ser. No. 447,509 filed May 23, 1995,now abandoned.

BACKGROUND OF THE INVENTION

1. Field of the Invention

This invention relates to polyol ester-based turbo oils which exhibit rust inhibition by use of additives. More particularly it relates to turbo oils comprising esters of pentaerythritol with fatty acids as base stock, and containing a combination of additives to impart rust resistance.

2. Description of the Prior Art

Corrosion and rust are conditions which are extremely harmful to sophisticated, close tolerance gas turbine engines. They are especially harmful, over time, to engines operated under severe stress, atmosphere, duration and maneuver conditions. Exposure to the elements, chemicals, wide temperature swings, water and corrosive moisture environments put a strain on the engines which impact on their reliability, shorten the intervals between servicing and increase the likelihood of major overhaul and key parts replacement.

The principle weapon in fighting corrosion and rust in gas turbine engines is lubricating oil as sophisticated as the engines themselves. Turbo oils of complex formulation based on synthetic base stocks have been developed to defend the engines against wear, corrosion, rust and the other harmful effects of oxidizing atmosphere, severe temperature and a generally hostile environment.

U.S. Pat. No. 4,320,018 is directed to a synthetic turbo oil comprising a major portion of an aliphatic ester base containing a phenylnaphthylamine, a dialkyldiphenylamine, a polyhydroxyanthraquinone, a hydrocarbylphosphate ester and a dialkyldisulfide compound. This oil is described as useful over a wide range of temperatures and as exhibiting good thermal and oxidative stability.

WO 94/10270 is directed to a corrosion inhibiting lubricant composition comprising a synthetic ester base stock, at least one aromatic amine antioxidant, a neutral organic phosphate, saturated or unsaturated dicarboxylic acids, a straight or branched chain saturated or unsaturated monocarboxylic acid which is optionally sulfurized or an ester of such an acid, and a triazole compound. This formulation is described as meeting the latest revision of Military Specification MIL-L-23699D of the United States Navy designated XAS-L-5724 (MIL-L-23699E) with respect to anticorrosion properties.

Other references which teach synthetic ester based turbine oils containing various combinations of additives are U.S. Pat. No. 4,226,732, U.S. Pat. No. 4,216,100, U.S. Pat. No. 4,189,388, U.S. Pat. No. 4,188,298, U.S. Pat. No. 4,179,386, U.S. Pat. No. 4,157,971, U.S. Pat. No. 4,157,970, U.S. Pat. No. 4,141,845, U.S. Pat. No. 4,141,844, U.S. Pat. No. 4,124,514, U.S. Pat. No. 4,124,513, U.S. Pat. No. 4,119,551, U.S. Pat. No. 4,096,078, U.S. Pat. No. 4,064,059, U.S. Pat. No. 4,248,721, U.S. Pat. No. 4,049,563. An improved synthetic ester base stock per se is described and claimed in U.S. Pat. No. 4,826,633.

SUMMARY OF THE INVENTION

Figure 1:
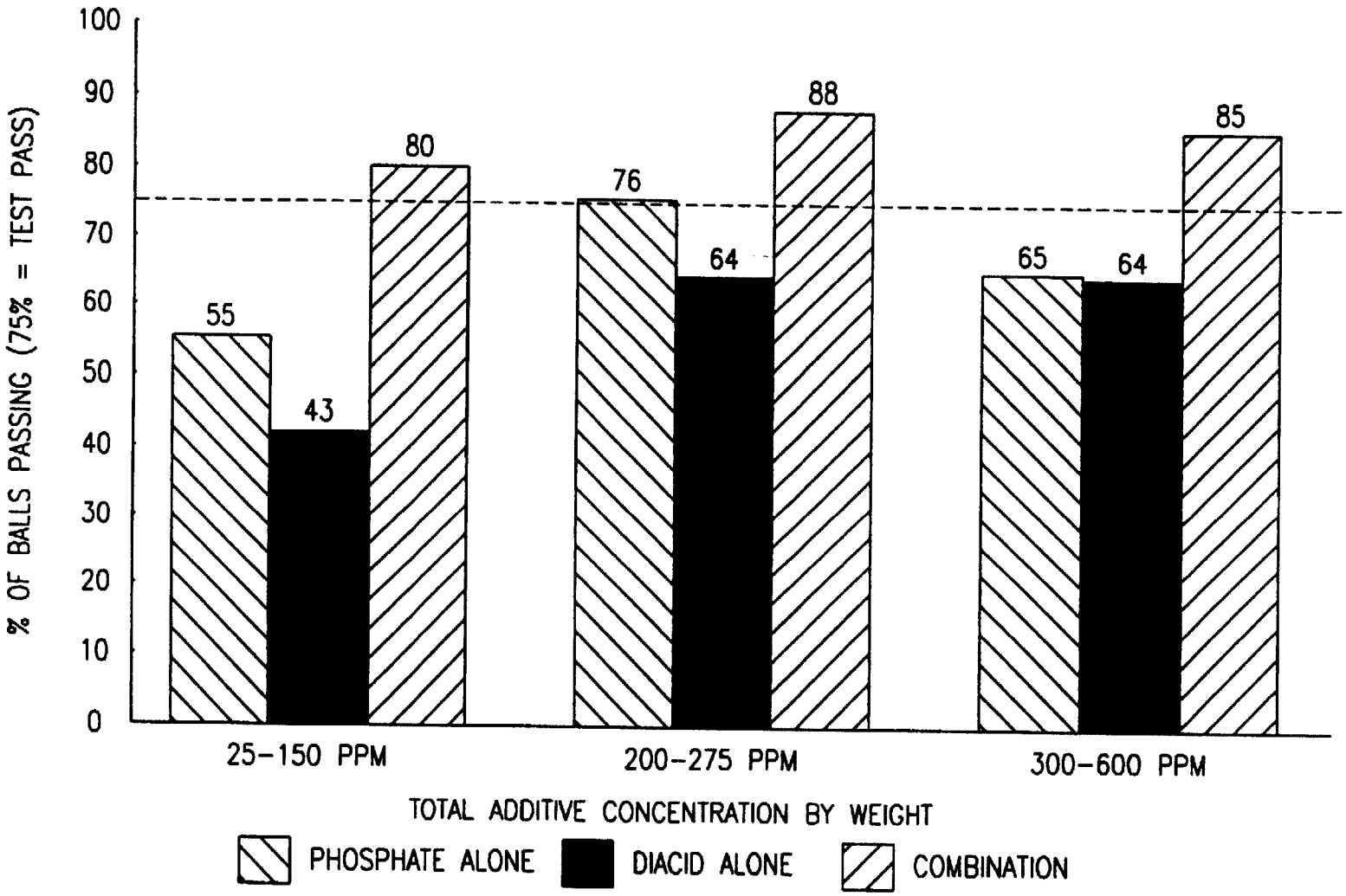
FIG. 1 presents a comparison of the MIL-L-23699E Ball Corrosion Test Performance of turbo oils containing amine phosphate and diacid alone and in combination at three different total additive concentration ranges. In all instances the combination exceeded each component's individual performance as well as what would have been expected from combining each component's individual contribution.

The present invention resides in a turbo oil composition exhibiting enhanced resistance to rust and corrosion and to a method for achieving that result in turbo oils.

The gas turbine lubricating oil of the present invention comprises a major proportion of a synthetic polyol ester based base stock and a minor proportion of an antirust/corrosion additive comprising an amine phosphate and a diacid. Other, conventional additives such as extreme pressure, pour point reduction, oxidative stability, antifoaming, improved viscosity index performance, anti-wear, hydrolytic stability agents, corrosion inhibitor additives and others may also be employed.

Lubricating oil additives are described generally in "Lubricants and Related Products" by Dieter Klamann, Verlag Chemie, Deerfield Beach, Fla., 1984.

Such improved antirust/anticorrosion performance in turbo lube oils is achieved by adding to the synthetic polyol ester based lubricating oil an additive package containing a mixture of amine phosphate and dicarboxylic acid.

The amine phosphate is used in an amount in the range 25 to 500 ppm preferably 50 to 250 ppm, most preferably 75 to 150 ppm, while the diacid is used in an amount in the range 25 to 1000 ppm, preferably 50 to 400 ppm, most preferably 75 to 200 ppm, the combination of amine phosphate and diacid being used in a total amount in the range 50 to 1500 ppm, preferably 100 to 400 ppm, most preferably 100 to 300 ppm.

The use of amine phosphate-dicarboxylic acid additive mixture produced a turbo oil exhibiting markedly superior rust resistance and anticorrosion properties performance as compared to the performances exhibited if each additive component is employed alone, and compared to the performance results expected had one simply combined each component's individual contribution.

DETAILED DESCRIPTION

A turbo lube having unexpectedly superior rust resistance and anticorrosion performance properties is disclosed, said oil comprising a major portion of a synthetic polyol ester base oil and a minor portion of an antirust—anticorrosion additive package consisting essentially of a mixture of monobasic amine phosphate and dicarboxylic acid.

The synthetic polyol ester base oil is formed by the esterification of aliphatic polyols with carboxylic acids. The aliphatic polyol reactant contains from 4 to 15 carbon atoms and has from 2 to 8 esterifiable hydroxyl groups. Examples of polyols are trimethylolpropane, pentaerythritol, dipentaerythritol, neopentyl glycol, tripentaerythritol and mixtures thereof.

The carboxylic acid reactant used to produce the synthetic polyol ester base oil is selected from aliphatic monocarboxylic acids or a mixture of aliphatic monocarboxylic acids and aliphatic dicarboxylic acids. The carboxylic acid contains from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the formula

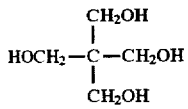

and about 12% of dipentaerythritol having the formula

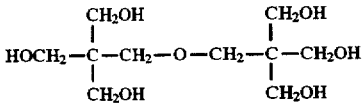

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims the term "technical pentaerythritol ester" is understood as meaning the polyol ester base oil prepared from technical pentaerythritol and a mixture of $C_4$–$C_{12}$ carboxylic acids.

As previously stated, to the polyol ester base stock is added a minor portion of an additive mixture comprising one or more amine phosphates and one or more dicarboxylic acids.

The monobasic amine phosphate(s) used include mono basic hydrocarbyl amine salts of acid phosphates and preferably are those of the formula:

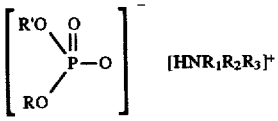

where

R and $R^1$ are the same or different and are $C_2$ to $C_{24}$ linear or branched chain alkyl $R_1$ is H or $C_4$ to $C_{20}$ linear or branched chain alkyl or $R_4$-aryl-$R_5$ where $R_4$ and $R_5$ are the same or different and are H or $C_1$–$C_{16}$ alkyl $R_2$ is $C_4$–$C_{20}$ linear or branched chain alkyl or $R_4$-aryl-$R_5$ where $R_4$ and $R_5$ are the same or different and are H or $C_1$–$C_{16}$ alkyl $R_3$ is $C_4$–$C_{20}$ linear or branched chain alkyl or $R_4$-aryl-$R_5$ where $R_4$ and $R_5$ are the same or different and are H or $C_1$–$C_{16}$ alkyl The preferred monobasic amino phosphates are those wherein R is straight or branched chain $C_6$–$C_{16}$ alkyl.

The monobasic amine phosphates are used in an amount in the range 25 to 500 ppm (based on polyol ester base stock) preferably 50 to 250 ppm, most preferably 75 to 150 ppm.

The dicarboxylic acid is a $C_{10}$ to $C_{40}$ total carbon numbers dicarboxylic acid, or mixture thereof, preferably a $C_{24}$ to $C_{40}$ dicarboxylic acid, or mixture thereof, most preferably a $C_{36}$ dicarboxylic acid or mixture thereof. The dicarboxylic acids can be any n-alkyl, branched alkyl, aryl, or alkyl substituted aryl dicarboxylic acid or mixture thereof having a total number of carbons falling within the above recited ranges. Preferred dicarboxylic acids are selected from the group consisting of the commercially available di-oleic acids known as "dimer acids", sebacic acid, azelaic acid and mixtures thereof.

The dicarboxylic acids are used in an amount in the range 25 to 1000 ppm (based on polyol ester base stock) preferably 50 to 400 ppm, most preferably 75 to 200 ppm.

The mixture of amine phosphate and dicarboxylic acid is used in an amount in the range 50 to 1500 ppm (based in polyol ester base stock), preferably 100 to 400 ppm, most preferably 100 to 300 ppm.

The amine phosphates and the decarboxylic acids are used in a ratio in the range 5:1 to 1:5, preferably 2:1 to 1:2.

The synthetic polyol ester—rust inhibiting additive containing turbo oil may also contain one or more of the following classes of additives: antioxidants, antiwear agents, extreme pressure additives, antifoamants, detergents, hydrolytic stabilizers and metal deactivators. Total amounts of such other additives can be in the range 0.5 to 15 wt %, preferably 2 to 10 wt %, most preferably 3 to 8 wt %.

Antioxidants which can be used include aryl amines, e.g. phenylnaphthylamines and dialkyl diphenyl amines and mixtures thereof, hindered phenols, phenothiazines, and their derivatives.

The antioxidants are typically used in an amount in the range 1 to 5 wt %.

Antiwear/extreme pressure additives include hydrocarbyl phosphate esters, particularly trihydrocarbyl phosphate esters in which the hydrocarbyl radical is an aryl or alkaryl radical or mixture thereof. Particular antiwear/extreme pressure additives include tricresyl phosphate, triaryl phosphate and mixtures thereof. Other or additional anti wear/extreme pressure additives may also be used.

The antiwear/extreme pressure additives are typically used in an amount in the range 0 to 4 wt. %, preferably 1 to 3 wt %.

Industry standard corrosive inhibitors may also be included into the turbo oil. Such known corrosion inhibitors include the various triazols.

For example, tolyltriazol, 1,2,4 benzene triazol, 1,2,3 benzene triazol, carboxy benzotriazole, alkylated benzotriazol.

The standard corrosion inhibitor additive can be used in an amount in the range 0.02 to 0.5 wt %, preferably 0.05 to 0.25 wt %.

As previously indicated, other additives can also be employed including hydrolytic stabilizers pour point depressants, anti foaming agents, viscosity and viscosity index improver, etc.

The turbo oils of the present invention meet or exceed the requirements set out by the United States Navy in MIL-L-23699E for corrosion inhibition type 5 cSt turbo oils. The MIL-L-23699E ball corrosion performance test is passed (75%=pass test) by polyol ester based, fully formulated, turbo oils to which have been added the antirust/corrosion inhibiting additive of the present invention consisting of a mixture of amine phosphate(s) and dicarboxylic acid(s).

The present invention is further described by reference to the following non-limiting examples.

EXPERIMENTAL

In the following examples a series of fully formulated aviation turbo oils were used which met all the specifications of MIL-L-23699. A polyol ester base stock prepared by reacting pentaerythritol with a mixture $C_5$ to $C_{10}$acids was employed along with a standard additive package containing from 1.7–2.5% by weight aryl amine antioxidants, 1.5–2% tri-aryl phosphates, 0.1% benzo or alkyl-benzotriazole, and 0 to 0.04% ditridecyl amine. To this was added various corrosion inhibition packages which consisted of the following:

1) Phosphate alone: a monobasic phosphate amine where the alkyl substituents on the phosphate were primarily ethyl hexyl or octyl, but also contained some chains from $C_6$ to $C_{16}$ in length. (Ortholeum 535)
2) Diacid alone: Commercial dimerized oleic acids or Sebacic acid. The dimerized oleic acids contain many specific chemicals including cyclic and aromatic structures and which have a small amount (<3%) of undimerized acids and a small amount 2–10% of trimerized acids.
3) Combination (the present invention): the combination of the two materials described in (1) and (2) above.

These oils were testing in the MIL-L-23699E specification Ball Corrosion test for rust inhibition performance. This test simulates the ability of the oil to prevent the corrosion of stainless steel balls due to action by sea water and is fully described under the MIL-L-23699E specification. Typically, though not always, 10 balls are used in each experiment on a test oil along with 4 balls used to test a reference failing oil and 4 balls used to test a reference passing oil. An oil passes the Ball Corrosion test if at least 75% of the balls have no rust pits on them at the conclusion while the passing oil also shows at least 75% passing balls (at least 3 or 4) and the failing oil shows less than 75% passing balls (at most 2 of 4).

The results from a series of tests are shown in FIG. 1 over three concentration ranges. In all cases the concentration refers to the total corrosion additive concentration employed. For the combination cases, ratios between 1 part phosphate to 2 parts diacid and 2 parts phosphate to 1 part diacid by weight was used.

FIG. 1 shows the total percentage of balls passing over all experiments for the three corrosion inhibitor systems over the concentration ranges shown. In all three cases there was not a statistically significant trend over the three ranges shown at the 95% confidence level. Neither the phosphate or diacid ingredient used alone provided reliable protection from rust with fewer than half of the tests passing the minimum 75% specification. However, the combination of the two ingredients, used at the same total additive treat rate exhibited a synergistic effect, and increased the likelihood of a pass result greatly. The results are shown below in Table 1.

TABLE 1

| | Total Balls/ Balls Passing | % of Balls Passing | Total Tests/ Passing Tests | % of Tests Passing |
|---|---|---|---|---|
| Phosphate Amine Alone | 149/99 | 66% | 15/8 | 53% |
| Diacid Alone | 111/62 | 56% | 12/4 | 33% |
| Combination of Diacid & Phosphate Amine | 252/213 | 85% | 25/21 | 84% |

This table demonstrates that over a range of turbo oil formulations, the only case where consistent performance in the Ball Corrosion tests was demonstrated was for the combination of both ingredients. A passing result could not be obtained consistently from either ingredient when used alone, even if the concentration was increased to above 300 ppm, a concentration which would have caused other performance problems in the turbo oil (excessive Initial Acid number and poor hydrolytic stability for the diacid, excessive degradation of silicone seals for the phosphate amine).

EXAMPLE 2

In this example a series of turbo oils was used similar to those in Example 1, with the following differences. Here the use of a mixed mono-basic and dibasic phosphate amine as the corrosion inhibitor was investigated. The phosphate amines used were the commercial products Vanlube-692 and Vanlube-672 which are mixed methyl and butyl mono and di-basic phosphates. The Vanlube-692 is primarily butyl, while the Vanlube-672 has more methyl groups.

These materials were employed at 100–200 ppm along with 150 ppm of a commercial di-oleic acid, Empol 1022. In two experiments, 12 of 27 balls passed (44%) with 1 of the two tests having at least 75% passing balls (50% test pass).

In a second set of runs, 100 ppm of Vanlube-692 was added to a formulation containing 150 ppm of a commercial phosphate amine, Ortholeum 535 and 150 ppm of a commercial di-oleic acid, Empol 1022. From FIG. 1 it is seen that 85% of the balls using the combination of monobasic phosphate and diacid at a total of 300 ppm would be expected to pass in the absence of Vanlube-692, Table 1 indicating that this combination, should pass 84% of all tests. However, in results of 4 replicate runs at the U.S. Navy Testing Laboratory in which mixed mono and di-basic amine phosphates were added to the formulation containing mono-basic amine phosphate only 15 of 50 balls (30%) passed while none (0 of 4) of the tests produced 50% passing balls.

This example demonstrates the need for the use of mono-basic phosphate to achieve successful results as the di-basic phosphates were not effective in combination with the diacid, and degraded the performance of the mono-basic phosphate amine-dicarboxylic acid synergistic combination.

What is claimed is:

1. A method for enhancing the resistance to rust and corrosion of a synthetic polyol ester based turbo oil by adding to said turbo oil a minor portion of an additive comprising a mixture of amine phosphate and dicarboxylic acid said dicarboxylic acid being a $C_9$ to $C_{40}$ total carbon number dicarboxylic acid or mixture thereof and wherein the amine phosphate consists of monobasic amine phosphate wherein the dicarboxylic acid is present in an amount in the range 25 to 1000 ppm and the amine phosphate is present in an amount in the range 25 to 500 ppm and the ratio of amine phosphate to dicarboxylic acid is in the range 5:1 to 1:5.

2. The method of claim 1 wherein the synthetic polyol ester based base stock is the esterification product of an aliphatic polyol containing 4 to 15 carbon atoms and from 2 to 8 esterifiable hydroxyl groups reacted with a carboxylic acid containing from 4 to 12 carbon atoms.

3. The method of claim 2 wherein the polyol ester based base stock is the esterification product of technical pentaerythritol and a mixture of $C_4$ to $C_{12}$ carboxylic acids.

4. The method of claims 1, or 3 wherein the amine phosphate is the mono-basic hydrocarbyl amine salt of acid phosphates.

5. The method of claim 4 wherein the amine phosphate is of the formula

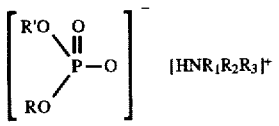

wherein R and R' are the same or different and are $C_2$ to $C_{24}$ linear or branched alkyl, $R_1$ is H or $C_4$ to $C_{20}$ linear or branched chain alkyl or $R_4$-aryl-$R_5$ wherein $R_4$ and $R_5$ are the same or different and are H or $C_1$–$C_{16}$ alkyl, $R_2$ and $R_3$ are $C_4$–$C_{20}$ linear or branched chain alkyl or $R_4$-aryl $R_5$ where $R_4$ and $R_5$ are the same or different and are H or $C_1$–$C_{16}$ alkyl.

6. The method of claim 5 wherein R is straight or branched chain $C_6$–$C_{16}$ alkyl.

7. The method of claim 4 wherein the dicarboxylic acids are dioleic acids, sebacic acid, azelaic acid and mixtures thereof.

* * * * *